US005956543A

United States Patent [19]

Aslam et al.

[11] Patent Number: 5,956,543

[45] Date of Patent: Sep. 21, 1999

[54] FUSING APPARATUS PROVIDING TUNING OF IMAGE GLOSS TO MATCH GLOSS OF RECEIVER MEMBER

[75] Inventors: Muhammed Aslam, Rochester; William J. Staudenmayer, Pittsford, both of N.Y.

[73] Assignee: Eastman Kodak Company, Rochester, N.Y.

[21] Appl. No.: 09/197,301

[22] Filed: Nov. 20, 1998

[51] Int. Cl.[6] ..... G03G 15/00

[52] U.S. Cl. ..... 399/45; 399/67; 399/341

[58] Field of Search ..... 399/45, 67, 68, 399/69, 320, 328, 341, 342, 330, 331

[56] References Cited

U.S. PATENT DOCUMENTS

| | | | |
|---|---|---|---|
| 4,634,262 | 1/1987 | Imaizumi et al. | 399/45 |
| 4,873,553 | 10/1989 | Inaba | 399/67 |
| 5,053,814 | 10/1991 | Takano et al. | 399/45 X |
| 5,194,890 | 3/1993 | Haruna et al. . | |
| 5,282,001 | 1/1994 | Watson | 399/67 X |
| 5,339,146 | 8/1994 | Aslam et al. . | |
| 5,450,183 | 9/1995 | O'Leary . | |
| 5,493,378 | 2/1996 | Jamzadeh et al. . | |
| 5,521,688 | 5/1996 | Moser . | |
| 5,581,339 | 12/1996 | Jamzadeh et al. . | |
| 5,678,133 | 10/1997 | Siegel | 399/67 |
| 5,831,744 | 11/1998 | Kataoka | 399/45 X |
| 5,852,462 | 12/1998 | Lloyd et al. | 399/45 X |

*Primary Examiner*—Sandra L. Brase
*Attorney, Agent, or Firm*—Lawrence P. Kessler

[57] ABSTRACT

A reproduction apparatus fuser providing for tuning of the fuser operating parameters to match the gloss of a fused marking particle image to the gloss of a receiver member to which such image is fused. The fuser includes a heated fuser roller, with a pressure roller in adjustable nip relation with the heated fuser roller. A mechanism regulates the speed of transport of a receiver member through the nip between the heated fuser roller and the pressure roller. A control device selectively, individually adjusts the temperature of the heated fuser roller, the pressure in the nip between the heated fuser roller and the pressure roller, and the receiver member transport speed regulating mechanism in an optimum predetermined manner based upon the characteristics of a receiver member upon which a marking particle image is to be fused.

11 Claims, 4 Drawing Sheets

10
22
20
L
T
M
P
18
14
12
16
LAMP

FUSING APPARATUS PROVIDING TUNING OF IMAGE GLOSS TO MATCH GLOSS OF RECEIVER MEMBER

FIELD OF THE INVENTION

This invention is directed in general to a fuser for a reproduction apparatus, and more particularly to reproduction apparatus fuser which provides for tuning to match the image gloss to that of the receiver member.

BACKGROUND OF THE INVENTION

In typical commercial electrostatographic reproduction apparatus (copier/duplicators, printers, or the like), a latent image charge pattern is formed on a uniformly charged charge-retentive or photo-conductive member having dielectric characteristics (hereinafter referred to as the dielectric support member). Pigmented marking particles are attracted to the latent image charge pattern to develop such image on the dielectric support member. The developed image is transferred to a receiver member, such as a sheet of paper, transparency or other medium, in an electric field. After transfer, the receiver member bearing the transferred image is transported away from the dielectric support member, and the image is fixed (fused) to the receiver member by heat and pressure to form a permanent reproduction thereon.

Certain reproduction apparatus have been designed to produce multi-color copies. In such reproduction apparatus, multiple color separation images are respectively developed with complementary colored marking particles, and then transferred in superposition to a receiver member. It has been found that fixing of multi-color marking particle images to a receiver member requires substantially different operating parameters than fixing standard black marking particle images to a receiver member. Moreover, the respective operating parameters may in fact be in contradistinction. That is, multi-color images require a high degree of glossiness for a full, rich depth of color reproduction; on the other hand, since glossiness for black marking particle images may significantly impair legibility, a matte finish is preferred.

Additionally, in the multi-color copy market, many different types of receiver members are utilized. The receiver members vary in surface finish gloss, weight, and thickness. Since the market demands a high quality appearance for finished copies, the image gloss should match the gloss of the selected receiver member, and the gloss of the images on both sides of duplex copies should also match.

It is known that the glossiness of a marking particle image is, at least in part, dependent upon the marking particle melting characteristics in the fusing process and the characteristics of the receiver members. In general, the fusing apparatus serves to soften or at least partially melt the marking particles, enabling the marking particles to permeate into the fibers of the receiver member so that the marking particles are fixed to the receiver member. For example, the fusing apparatus may include a heated roller which contacts the marking particles and the receiver member under pressure. If color marking particle images are not sufficiently melted, light scattering cavities may occur in the copy which degrades the color reproduction. Moreover, if the marking particles on the receiver member do not have a mirror-like surface, incident light is reflected by diffusion from the marking particle surface and is not admitted into the marking particle layers, making the colors on the receiver member appear dark and cloudy.

For efficient overall operation of reproduction apparatus, such apparatus must be capable of satisfactorily accomplishing different copy jobs on receiver members of varying characteristics. The length of the job run, as well as the receiver member characteristics, has been shown to impact fusing and image gloss. Quality fusing and proper gloss, as discussed above, are necessary to provide desirable copy output. At the present time, the typically available reproduction apparatus require some compromises in copy quality. They do not exhibit the wide range of operation necessary to provide for the desired tuning of image gloss so as to match image gloss to the gloss of the selected receiver member, and match the gloss of the images on both sides of duplex copies.

SUMMARY OF THE INVENTION

In view of the above, this invention is directed to a fuser for a reproduction apparatus which provides for image gloss tuned so as to match image gloss to the gloss of the selected receiver member, and match the gloss of the images on both sides of duplex copies. The reproduction apparatus fuser as disclosed includes a heated fuser roller, with a pressure roller in adjustable nip relation with the heated fuser roller. A mechanism regulates the speed of transport of a receiver member through the nip between the heated fuser roller and the pressure roller. A control device selectively, individually adjusts the temperature of the heated fuser roller, the pressure in the nip between the heated fuser roller and the pressure roller, and the receiver member transport speed regulating mechanism in an optimum predetermined manner based upon the characteristics of a receiver member upon which a marking particle image is to be fused.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 2:
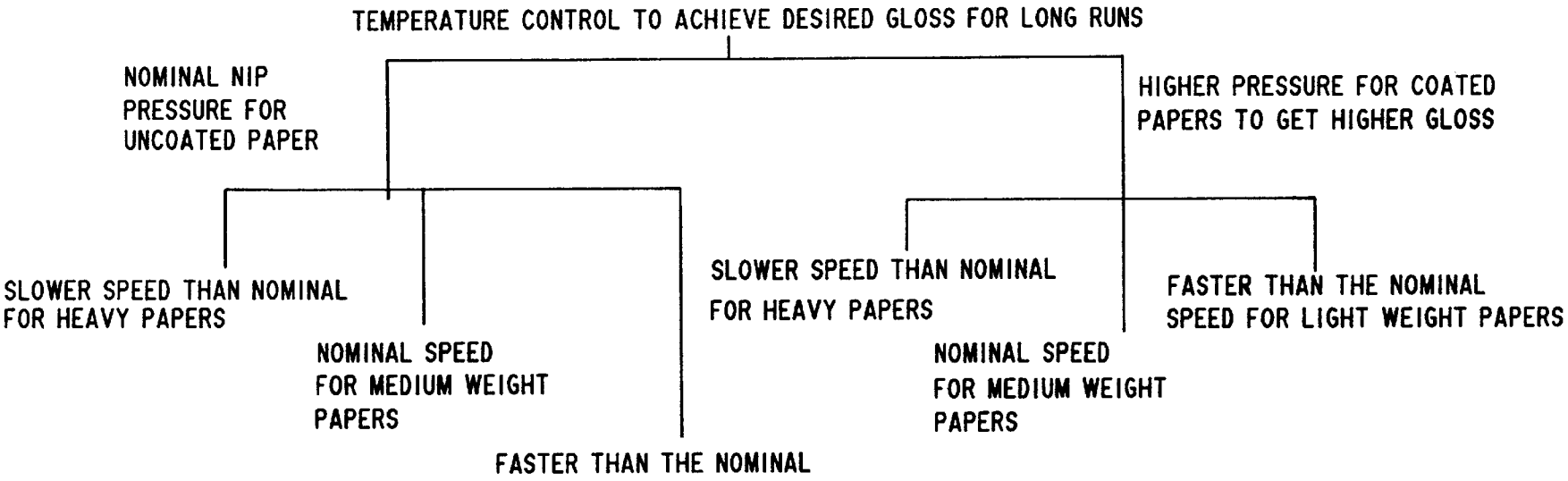
FIG. 2 is a logic tree for the reproduction apparatus fuser control, according to this invention.

Referring now to the accompanying drawings, a fuser, designated generally by the numeral 10, for a reproduction apparatus is shown in FIG. 2. The reproduction apparatus fuser 10 applies heat and pressure to a marking particle image on a receiver member transported through the fuser to permanently fix the image to the receiver member. The fuser 10 includes a fusing roller 12 having a rubber outer layer on a hollow heat conductive core such as aluminum or steel. A lamp 14, connected to a suitable power source T, is located internally of the core of the fusing roller 12. The lamp 14 provides the necessary heat to elevate the temperature of the fusing roller to a level required to at least soften a marking particle image on a receiver member for fusing the marking particle image thereto. An oiler mechanism 18 is located in operative association with the fusing roller 12 to apply a release oil coating to the roller. Such release oil coating will serve to inhibit the offset of marking particles from the receiver member being fused to the fusing roller.

Figure 1:
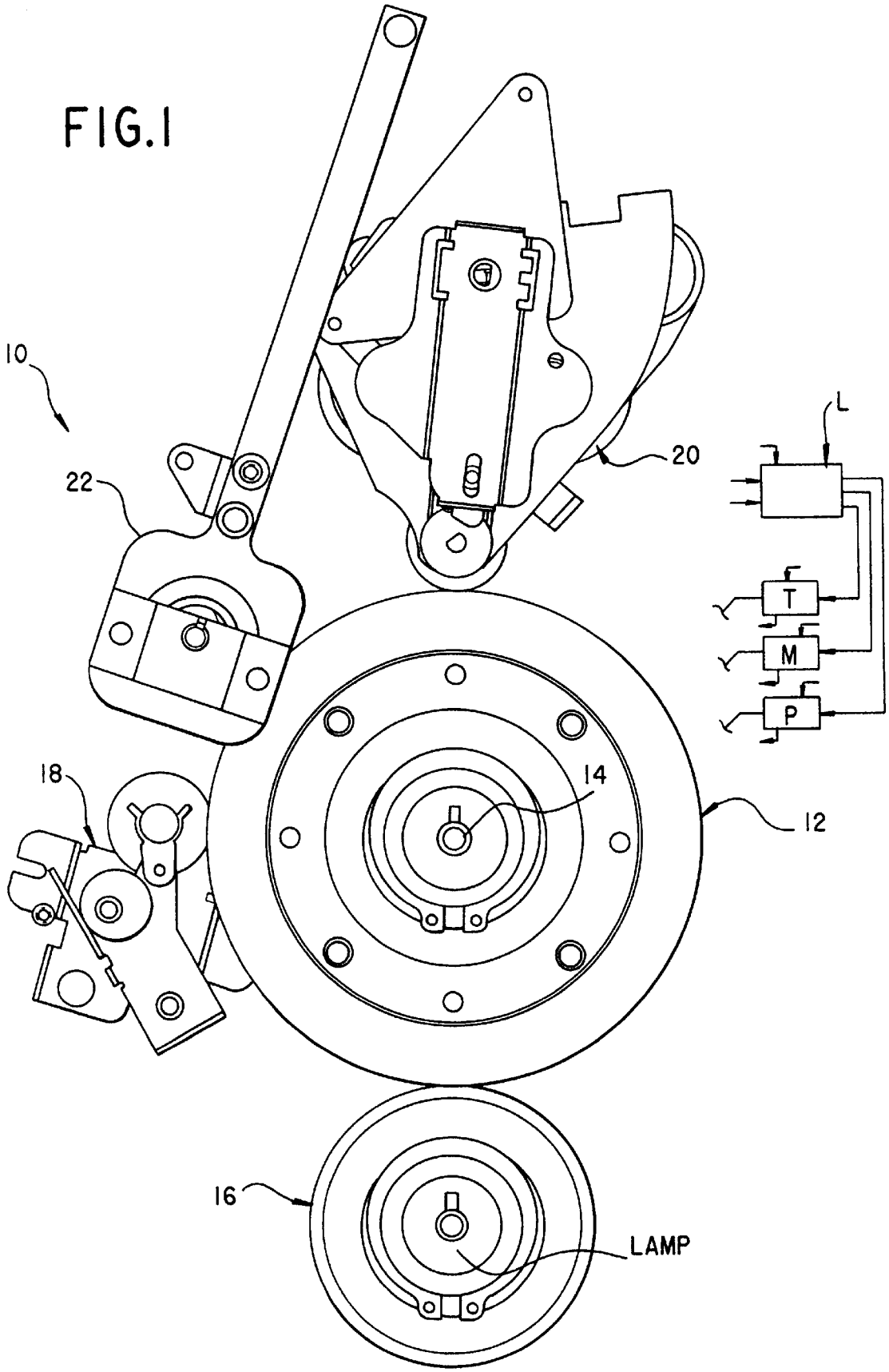
FIG. 1 is a side elevational view, on an enlarged scale, of a reproduction apparatus fuser, controlled according to this invention, for providing tuned image gloss over a wide range of fusing and receiver member characteristics.

A pressure roller 16, having a hard surface, is located in nip relation with the fusing roller 12. Any well known suitable pressure mechanism P (shown schematically in FIG. 1) selectively applies a particular force to create a desired pressure in the nip to effect the fusing of the marking particle image to the receiver member travelling through the nip. Travel of the receiver member is effected, for example, by a variable speed motor M (shown schematically in FIG. 1) which rotates the fuser roller 12 at a selected velocity. The nip between the fuser roller 12 and the pressure roller 16 then acts to transport the receiver member at a predetermined speed through the nip. Further, the fuser 10 includes a cleaning mechanism 20 engages the fusing roller 12 to clean the surface thereof. The fuser 10 may also include a mechanism 22 for selectively applying heat to the external surface of the fusing roller 12.

Appropriate sensors (not shown) of any well known type, such as mechanical, electrical, or optical for example, are utilized to provide control signals for the apparatus. Such sensors are located along the receiver member travel path through the reproduction apparatus, and are also located in association with the various image processing stations of the reproduction apparatus, including the fuser 10. As such, the sensors detect the location of a receiver member in its travel path, and produce appropriate signals indicative thereof. Such signals are fed as input information to a logic and control unit L including a microprocessor, for example. Based on such signals and a suitable program for the microprocessor, the unit L produces signals to control the timing operation of the various electrographic process stations for carrying out the reproduction process, and in particular control the operating parameters for the fuser 10. The production of a program for a number of commercially available microprocessors, which are suitable for use with the invention, is a conventional skill well understood in the art. The particular details of any such program would, of course, depend on the architecture of the designated microprocessor.

As discussed above, image gloss depends, in part, upon marking particle melting characteristics in the fusing process, and upon the characteristics of the receiver members. Melting characteristics are, in turn, dependent upon the physical properties of the marking particles, the fusing temperature, fusing pressure, and the speed of the receiver member through the nip between the fusing roller 12 and the pressure roller 16. Accordingly, the logic and control unit L of the fuser 10 provides suitable control signals for controlling the fuser operating parameters based upon the marking particle melting characteristics and the characteristics of the receiver members. Specifically, appropriate control signals are applied to the fuser heater lamp power source T for varying the temperature of the fusing roller 12, to pressure mechanism P for varying the pressure exerted by the pressure roller 16 in the fuser nip, and to the variable speed drive motor M for varying the speed of rotation of the fusing roller 12 (and thus regulating the transport speed of a receiver member through the fuser nip).

In order to tune image gloss to match the gloss of a particular one of various receiver member types to yield the desirable high quality finished copies, the fuser controls are selectively regulated in a predetermined optimized manner through an intelligent logic control algorithm applied with the logic and control unit L of the reproduction apparatus. That is, depending upon the characteristics of the receiver members upon which a copy job is being run and upon the copy job run parameters, the fuser temperature, pressure and nip speed for the reproduction apparatus fuser are individually selectively adjusted in a predetermined optimum manner to best match the resultant image gloss of the output copies to the known gloss of the receiver member upon which the copies are formed.

Figure 3:
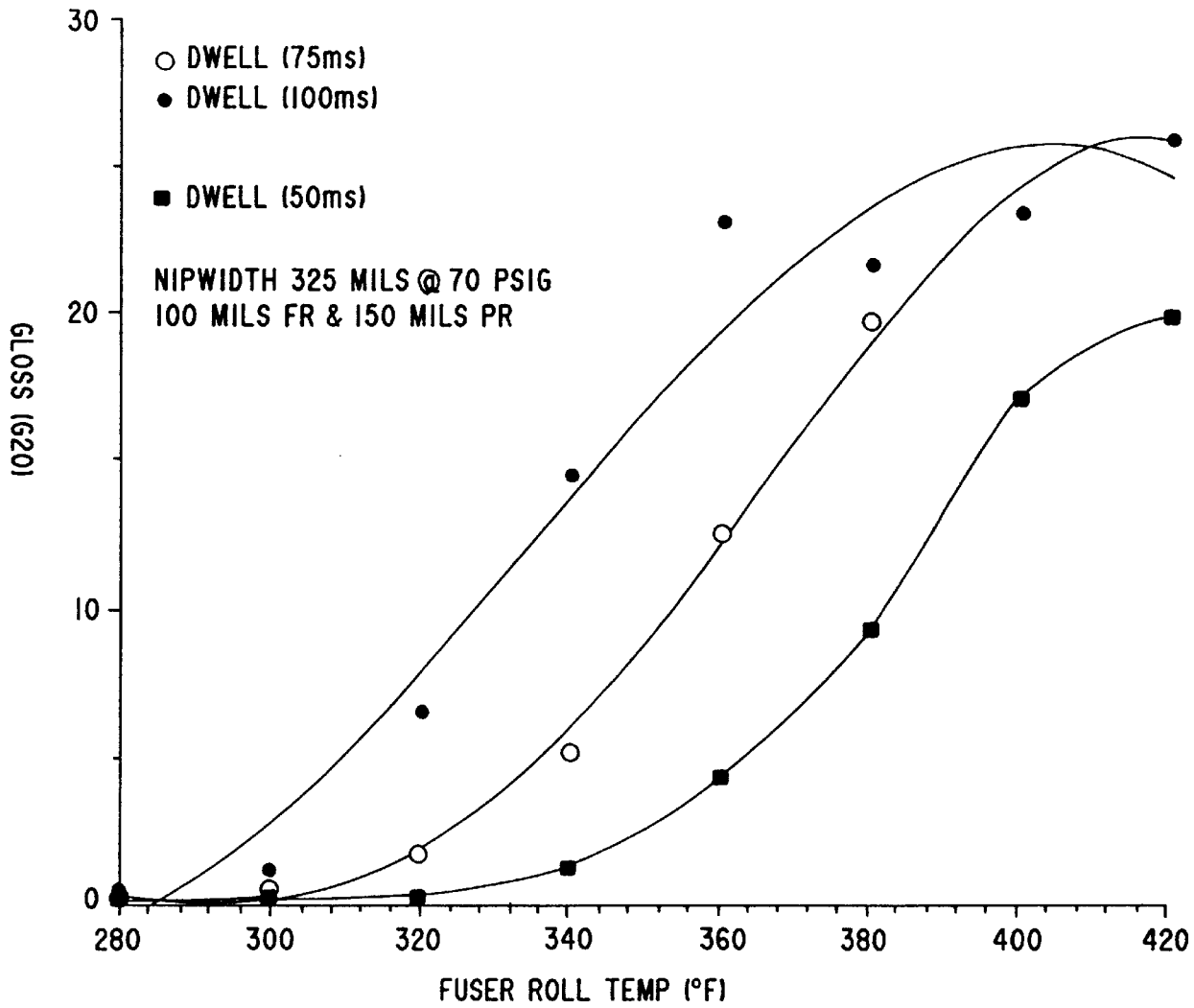
FIG. 3 is a graph depicting the dependence of image gloss on fusing temperature at different fuser speeds.
Figure 4:
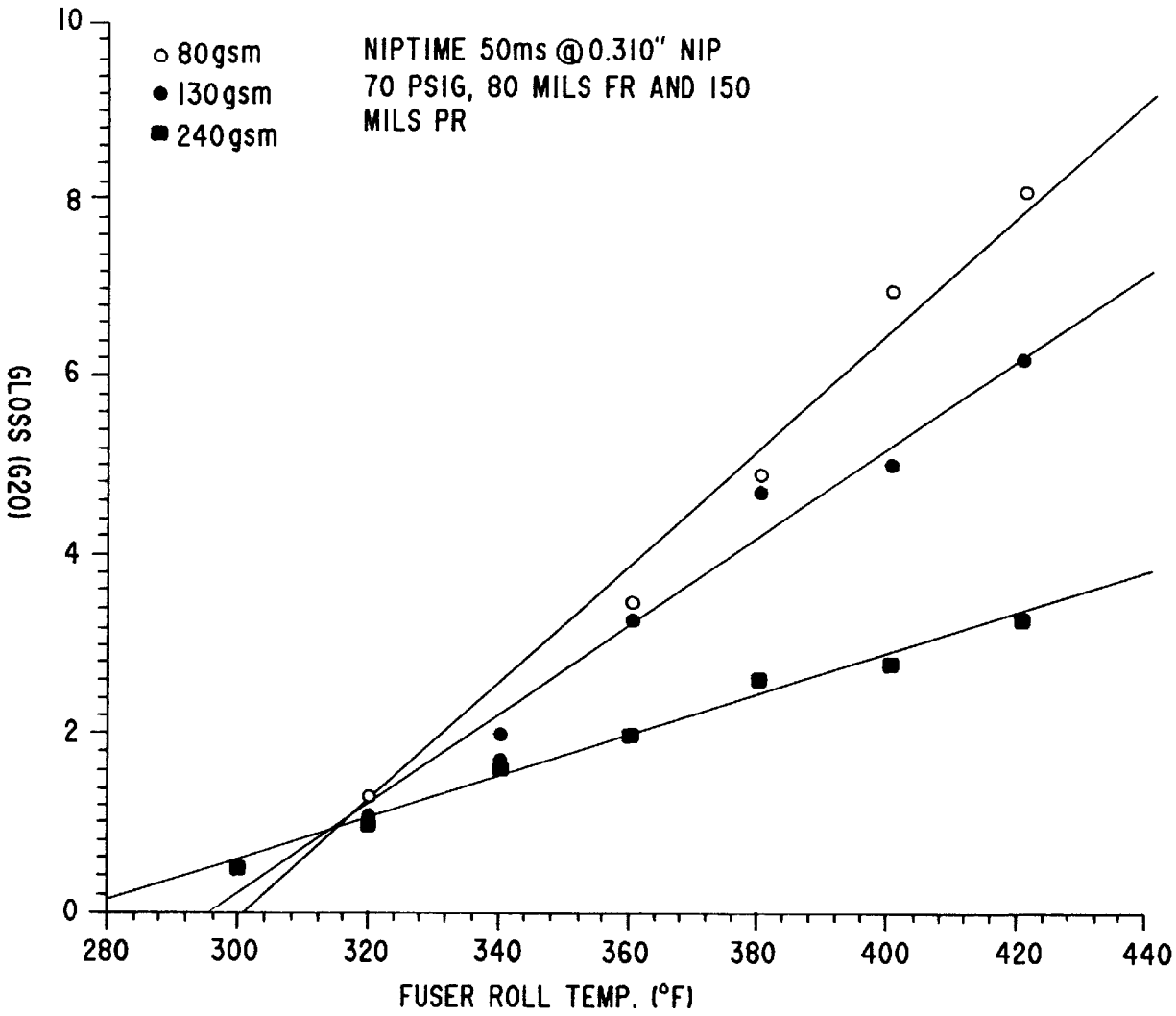
FIG. 4 is a graph depicting the dependence of image gloss on fusing temperature for receiver member weights.

FIG. 2 shows a logic tree where, for different receiver member parameters, different fuser control parameters are adjusted in an interrelated manner so as to optimally result in the desired gloss matching. As illustrated, the image gloss for long run jobs is tuned for various receiver member characteristics by setting the fuser roller pressure and nip speed for a particular fuser temperature, at a particular level for the desired image gloss according to the results found in formulated look-up tables generated by data like that found in FIGS. 3 and 4. FIG. 3 shows the relation of receiver member transport speed on image gloss for a given fuser temperature; and, FIG. 4 shows the relation of receiver member weight on image gloss for a given fuser temperature.

It is well known that for a fuser 10 of the type described above, fuser roller temperature takes a substantially time to stabilize. Therefore, controlling image gloss by only adjusting the fuser temperature setting would only be suitable for long copy runs utilizing one type of receiver member. In the instance where the copy job is of a mixed type (for example, uses coated and uncoated receiver members from two supply trays, but have the same weight range), then the nip pressure could be increased for glossy papers to get higher image gloss. Alternatively, the fuser speed could be decreased whereby a receiver member would spend more time in the fusing nip. Once the nip pressure is selected, the fuser speed may be adjusted to compensate for receiver member weight. For example, fuser speed would be selected so as to be slower than nominal speed for heavy papers, and faster than nominal speed for light weight papers. Further, if the copy job is of mixed type (i.e., both the receiver member weights and types are mixed from sheet to sheet), the image gloss would be matched to the gloss of the receiver members by changing nip pressure (nip width) as well as fuser speed by automatically sensing the type of receiver member, and the characteristics thereof, and having the logic and control unit L automatically refer to the lookup tables to set the fuser operating parameters. Alternatively, direct operator input to the logic and control unit could be provided.

The invention has been described in detail with particular reference to certain preferred embodiments thereof, but it will be understood that variations and modifications can be effected within the spirit and scope of the invention.

PARTS LIST

| PARTS LIST | |
|---|---|
| 10. reproduction apparatus fuser | L. logic and control unit |
| 12. fuser roller | T. heater lamp power source |
| 14. Corona charging device | P. pressure mechanism |
| 15. heater lamp | M. variable speed motor |
| 16. pressure roller | |
| 18. oiler mechanism | |
| 20. fuser roller cleaner | |
| 22. external heater | |

What is claimed is:

1. A reproduction apparatus fuser providing for tuning of the fuser operating parameters to match the gloss of a fused marking particle image to the gloss of a receiver member to which such image is fused, said fuser comprising:

a heated fuser roller;

a pressure roller in adjustable nip relation with said heated fuser roller;

a mechanism for regulating the speed of transport of a receiver member through said nip between said heated fuser roller and said pressure roller; and a control device for selectively, individually adjusting the temperature of said heated fuser roller, the pressure in said nip between said heated fuser roller and said pressure roller, and said receiver member transport speed regulating mechanism in an optimum predetermined manner based upon the characteristics of a receiver member upon which a marking particle image is to be fused.

2. The reproduction apparatus fuser of claim 1 wherein said control device further includes a microprocessor-based logic and control unit.

3. The reproduction apparatus fuser of claim 2 wherein said microprocessor-based logic and control unit includes lookup tables for fuser operating parameter combinations for desired image gloss.

4. The reproduction apparatus fuser of claim 1 wherein said fuser includes a lamp, located within said fuser roller, said lamp providing heat for said fuser roller when said lamp is turned on, and said control device selectively regulating the on time for said lamp to control the temperature of said fuser roller.

5. The reproduction apparatus fuser of claim 4 wherein said fuser includes an external heater device, contacting said fuser roller, said external heater device providing heat for said fuser roller when said external heater device is activated, and said control device selectively activating said external heater device to control the temperature of said fuser roller.

6. The reproduction apparatus fuser of claim 1 wherein said fuser includes a pressure mechanism for applying pressure to said nip between said fuser roller and said pressure roller, and said control device selectively activating said pressure mechanism to control pressure in said nip.

7. The reproduction apparatus fuser of claim 1 wherein said fuser includes a variable speed drive motor for rotating said fuser roller, and said control device selectively activating said drive motor to regulate the speed thereof.

8. The reproduction apparatus fuser of claim 1 wherein said fuser includes a lamp, located within said fuser roller, said lamp providing heat for said fuser roller when said lamp is turned on, a pressure mechanism for applying pressure to said nip between said fuser roller and said pressure roller, a variable speed drive motor for rotating said fuser roller, and said control device selectively regulating the on time for said lamp to control the temperature of said fuser roller. selectively activating said pressure mechanism to control pressure in said nip, and said selectively activating said drive motor to regulate the speed thereof.

9. The reproduction apparatus fuser of claim 8 wherein said control device includes a microprocessor-based logic and control unit having lookup tables for temperature, pressure and speed fuser operating parameter combinations for particular desired image gloss.

10. In a reproduction apparatus fuser providing for tuning of fuser operating parameters to match the gloss of a fused marking particle image to the gloss of a receiver member to which the image is fused, said fuser including a heated fuser roller, a pressure roller in adjustable nip relation with said heated fuser roller, a mechanism for regulating the speed of receiver member transport through said nip between said heated fuser roller and said pressure roller, and a control device, said control device comprising:

a microprocessor-based logic and control unit having lookup tables for temperature, pressure and speed fuser operating parameter combinations for particular desired image gloss, and means, associated with said lookup tables for selectively, individually adjusting the temperature of said heated fuser roller, the pressure in said nip between said heated fuser roller and said pressure roller, and said receiver member transport speed mechanism in an optimum manner based upon the characteristics of the receiver member upon which a marking particle image is to be fused.

11. In a reproduction apparatus having a fuser including a heated fuser roller, a pressure roller in adjustable nip relation with said heated fuser roller, a mechanism for regulating the speed of receiver member transport through said nip between said heated fuser roller and said pressure roller, and a control device, a method for controlling said fuser to provide for tuning of the fuser operating parameters to match the gloss of a fused marking particle image to the gloss of a receiver member to which the image is fused, said method comprising the steps of:

determining the characteristics and gloss of a receiver member to which a marking particle image is to be fused;

based upon the receiver member gloss determined above, determining the temperature, pressure and speed fuser operating parameter combinations for particular desired image gloss to match the receiver member gloss; and based upon the operating parameter characteristics determined above, selectively, individually adjusting the temperature of said heated fuser roller, the pressure in said nip between said heated fuser roller and said pressure roller, and said receiver member transport speed mechanism.

* * * * *